United States Patent [19]

Kozuki

[11] Patent Number: 4,926,736

[45] Date of Patent: May 22, 1990

[54] ELECTRONIC MUSICAL INSTRUMENT WITH AUTOMATIC PERFORMANCE APPARATUS

[75] Inventor: Koichi Kozuki, Hamamatsu, Japan

[73] Assignee: Yamaha Corporation, Hamamatsu, Japan

[21] Appl. No.: 210,030

[22] Filed: Jun. 22, 1988

[30] Foreign Application Priority Data

Jun. 25, 1987 [JP] Japan ..... 62-156600
Jun. 25, 1987 [JP] Japan ..... 62-156601

[51] Int. Cl.[5] ..... G10H 1/36; G10H 7/00

[52] U.S. Cl. ..... 84/609; 84/610; 84/649

[58] Field of Search ..... 84/1.01, 1.03, 1.28, 84/1.17, DIG. 2, DIG. 12, DIG. 22, DIG. 23, 1.19, 609–614, 649–652

[56] References Cited

U.S. PATENT DOCUMENTS 4,336,735 6/1982 Amano et al. ..... 84/DIG. 22 X
4,351,214 9/1982 Suzuki et al. ..... 84/DIG. 22 X
4,365,532 12/1982 Nakada et al. ..... 84/1.19
4,476,766 10/1984 Ishii ..... 84/1.28 X

FOREIGN PATENT DOCUMENTS 59-197095 11/1984 Japan .

*Primary Examiner*—Stanley J. Witkowski
*Attorney, Agent, or Firm*—Spensley Horn Jubas & Lubitz

[57] ABSTRACT

An electronic musical instrument producing a music having plural performance parts includes a generation channel unit including plural tone generation channels, a tone generation number designating unit, and a tone generation channel assigning unit. Each tone generation channel generates a tone of the music. The tone generation number designating unit designates a maximum simultaneous tone generation number to be given to each of the plural performance parts. The tone generation channel assigning unit assigns each of the plural performance parts to one or more available tone generation channels. The number of available tone generation channels is equal to the corresponding one of the designated maximum simultaneous tone generation numbers.

13 Claims, 17 Drawing Sheets

ELECTRONIC MUSICAL INSTRUMENT WITH AUTOMATIC PERFORMANCE APPARATUS

BACKGROUND OF THE INVENTION

The present invention relates to an electronic musical instrument with an automatic performance apparatus.

Conventionally, various types of a performance recording/reproducing apparatus having plural performance parts or an electronic musical instrument with a performance recording/reproducing apparatus having plural performance parts have been proposed (e.g., Japanese Patent Laid-Open No. 59-197095).

In such a performance recording/reproducing apparatus having plural performance parts, tone generation channels are provided in correspondence to each performance part. That is, the respective performance parts have tone generation channels independently from each other. Therefore, a maximum simultaneous tone generation number in one performance part is limited to the number of tone generation channels corresponding to the performance part, i.e., the number of tones more than that cannot be generated at the same time.

In addition, in the conventional performance recording/reproducing apparatus, a mode of the apparatus must be switched from a recording mode for recording to a reproducing mode for reproduction in order to reproduce recorded performance. For this reason, the performer must execute a switching operation to select the reproducing mode and depress a start switch.

SUMMARY OF THE INVENTION

It is, therefore, a principal object of the present invention to provide an electronic musical instrument in which tones can be simultaneously generated using plural tone generation channels and a combination of tone generation channels can be selected in accordance with a performance part within the range of the number of tone generation channels.

It is another object of the present invention to provide an electronic musical instrument in which after performance is recorded in a recording mode for recording performance, a mode of the electronic musical instrument is automatically switched from the recording mode to a reproducing mode for reproducing the performance.

In order to achieve the above objects of the present invention, there is provided an electronic musical instrument reproducing a music having plural performance parts comprising tone generation channel means including plural tone generation channels, each of which generates a tone of the music, tone generation number designating means for designating maximum simultaneous tone generation number to be given to each of the plural performance parts, and tone generation channel assigning means for assigning each of the plural performance parts to one or more available tone generation channel, the number of the available tone generation channel being equal to the corresponding one of the designated maximum simultaneous tone generation number.

DETAILED DESCRIPTION OF THE PREFERRED EMBODIMENT

An embodiment of the present invention will be described below.

Figure 1:
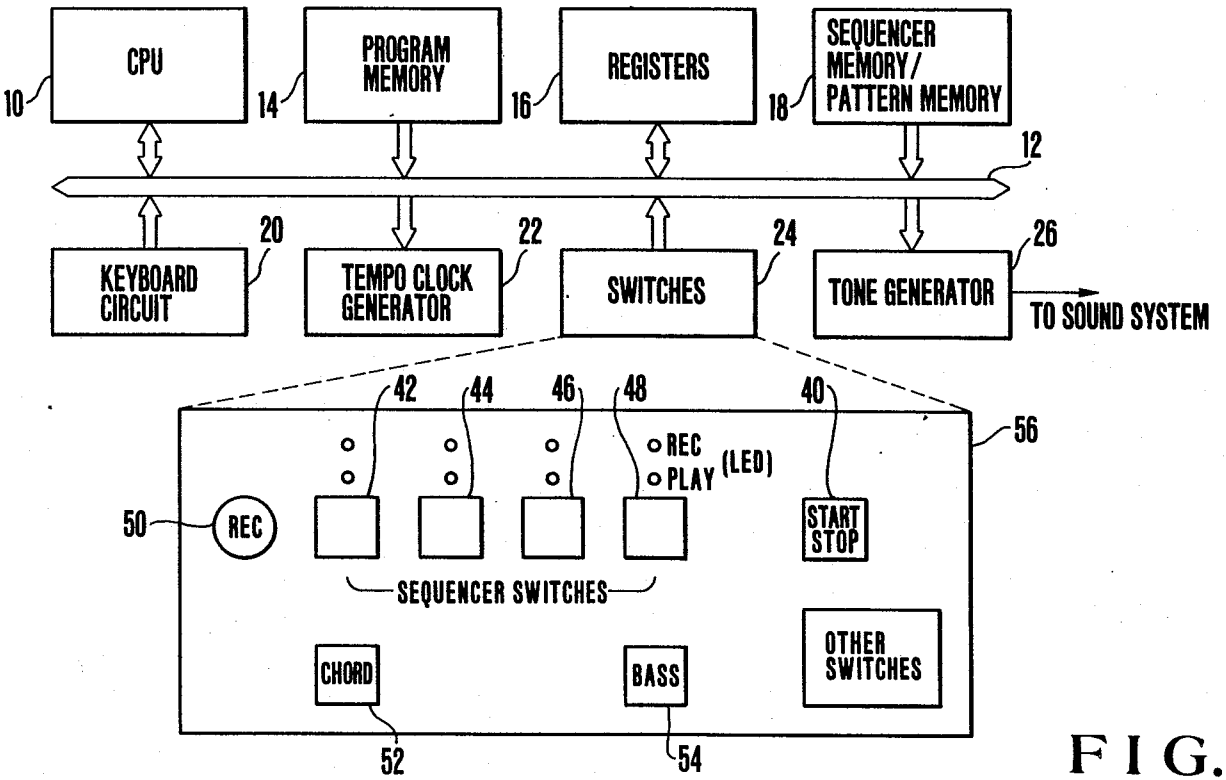
FIG. 1 is a block diagram showing a hardware arrangement of an electronic musical instrument according to an embodiment of the present invention.

FIG. 1 shows a hardware arrangement of an electronic musical instrument according to an embodiment of the present invention.

Description of Arrangement of Electronic Musical Instrument in FIG. 1

In FIG. 1, a central processing unit (CPU) 10 controls an operation of the entire electronic musical instrument. The CPU 10 is connected, through a bidirectional bus line 12, to a program memory 14, registers 16, a sequencer memory/pattern memory 18, a keyboard circuit 20, a tempo clock generator 22, switches 24, and a tone generator 26. The tone generator 26 is connected to a sound system such as are amplifier and a loudspeaker (neither of which are shown).

The program memory 14 is constituted by a read-only memory (ROM) and the like and stores control programs for the CPU 10.

Figure 2A:
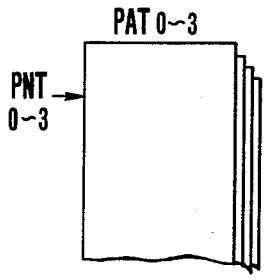
FIGS. 2A, 2B, and 2C are views showing data arrangements and formats of stored data of a sequencer memory and a pattern memory in FIG. 1.

The sequencer memory 18 stores performance data in correspondence to each performance part. The sequencer memory 18 is constituted by, e.g., a random access memory (RAM) and has four sequencer areas $PAT_0$ to $PAT_3$ in correspondence to the performance part, as shown in FIG. 2A. Note that sequencers are called sequencers 0 to 3 in correspondence to the sequencer areas $PAT_0$ to $PAT_3$.

Figure 2B:
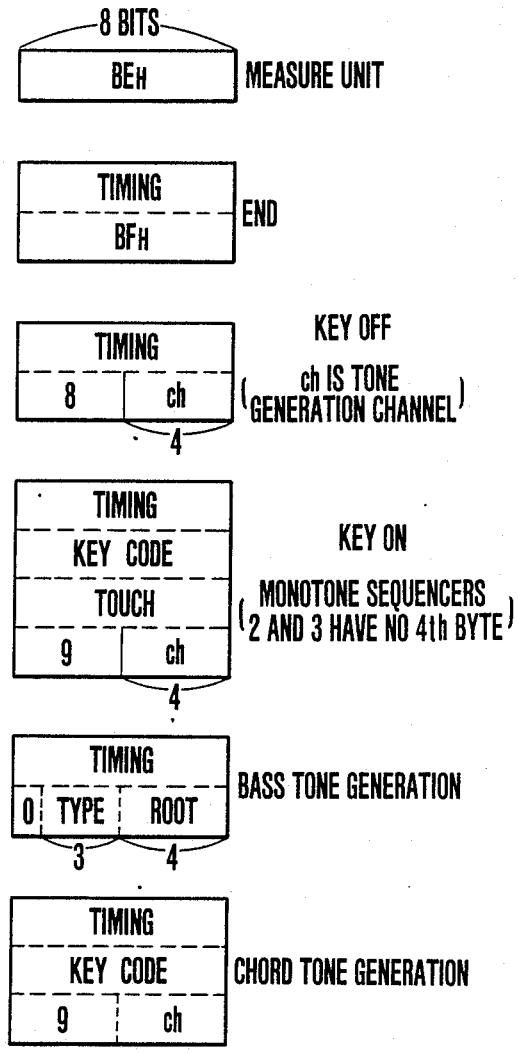

The sequencer areas $PAT_0$ to $PAT_3$ store event data such as "measure unit", "end", "key off", "key on", "bass tone generation", and "chord tone generation" having formats shown in FIG. 2B.

Data in which eight bits represent BEH represents the measure unit. Note that H represents hexadecimal notation. For example, BEH represents that "BE" in hexadecimal notation is set in an area of eight bits.

Data in which the second byte represents BFH represents the end of data stored in the sequencer memory. Timing data representing an end timing is set in the first byte.

Data in which upper four bits of the second byte represent 8H represents a key off event. The first byte is timing data representing a key off timing, and lower four bits of the second byte represent a tone generation channel.

In data representing a key on event, the first byte is timing data representing a key on timing, the second byte represents a key code, and the third byte is touch data. Upper four bits of the fourth byte represent 9H, and its lower four bits represent a tone generation channel. Note that each of sequencers 2 and 3 is a monotone sequencer assigned to one tore generation channel as will be described later. Therefore, the sequencers 2 and 3 need not have the fourth byte are hence are represented by formats without the fourth byte.

In bass tone generation data, the first byte is timing data, the most significant bit (MSB) of the second byte represents "0", its next three bits represent a chord type, and its lower four bits represent a fundamental note.

In chord tone generation data, the first byte is timing data, the second byte represents a key code upper four bits of the third byte represent 9H, and its lower four bits represent a tone generation channel. Note that unlike the bass tone generation data, the chord tone generation data is stored not in the form of a chord but of a key code.

Figure 2C:
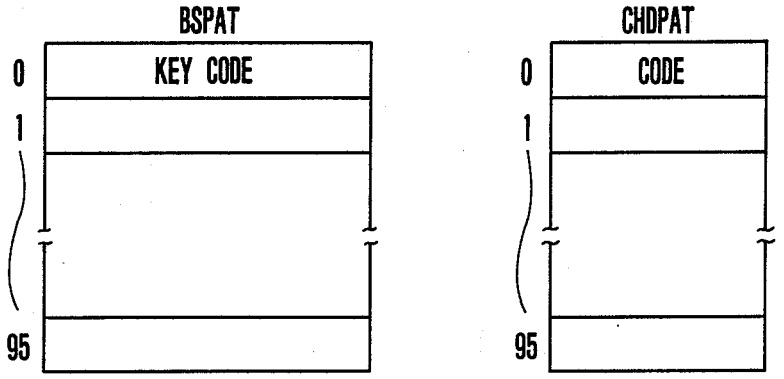

FIG. 2C shows an arrangement of the pattern memory 18. BSPAT is pattern data for bass tone generation. In the BSPAT, one measure is divided into 96 areas, and a key code to be generated is stored in an area of a predetermined timing at which a tone is generated. A CHDPAT is pattern data for tone generation of chord accompaniment. In the CHDPAT, one measure is divided into 96 areas, and a code is stored in an area of a predetermined timing. The code has values from 0 to 9, and tone generation processing as shown in Table 1 is performed in accordance with the value. Note that in Table 1, nth (n =1 to 4) is the number counted from a higher pitch side.

TABLE 1

| Value of CHDPAT | Tone Generation Processing |
|---|---|
| 0 | Key Off |
| 1 | Whole Tone Key On |
| 2 | First Tone Key On |
| 3 | Second Tone Key On |
| 4 | Third Tone Key On |
| 5 | Fourth Tone Key On |
| 6 | First Tone Key Off |
| 7 | Second Tone Key Off |
| 8 | Third Tone Key Off |
| 9 | Fourth Tone Key Off |

The keyboard circuit 20 includes a large number of key switches (not shown) corresponding to the respective keys of the keyboard and generates key event data which represents key depression and key release of a keyboard operation and a key code which is a key name.

The tempo clock generator 22 is constituted by a variable-frequency oscillator or a combination of a fixed-frequency oscillator and a frequency divider having a variable frequency dividing ratio, and generates a clock pulse corresponding to a predetermined tempo.

As shown in FIG. 1, the switches 24 include a start/-stop (S/S) switch 40, sequencer selecting (SEQ) switches 42 to 48, a recording (REC) switch 50, an auto chord (CHORD) switch 52, an auto bass (BASS) switch 54, and other switches 56.

The tone generator 26 forms a musical tone signal based on data representing key depression, key release, a tone color (or the type of a musical instrument), and pitch supplied from the CPU 10, and sends the signal to a sound system including an amplifier and the like. The sound system generates a musical tone on the basis of the musical tone signal.

Figure 3:
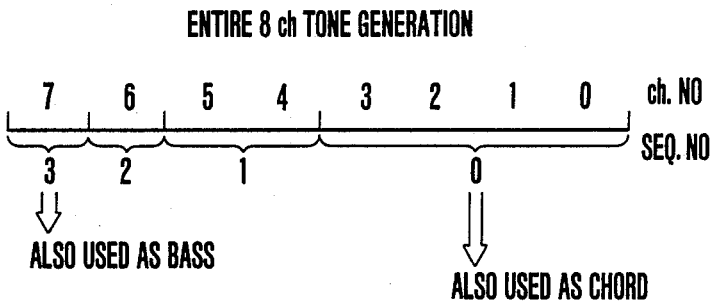
FIG. 3 is a view showing correspondence between tone generation channels and a sequencer.

In the electronic musical instrument shown in FIG. 1, the tone generator 26 includes eight tone generation channels (channel numbers 0 to 7), as shown in FIG. 3. The tone generation channels of the channel numbers 0 to 3 correspond to the sequencer 0. Similarly, the tone generation channels of the channel numbers 4 and 5 correspond to the sequencer 1, the tone generation channel of the channel number 6 corresponds to the sequencer 2, and the tone generation channel of the channel number 7 corresponds to the sequencer 3, respectively. An output from each sequencer is generated from the corresponding tone generation channel. Note that an automatic bass accompaniment is processed by the sequencer 3, and an automatic chord accompaniment is processed by the sequencer 0, respectively. The tone generation channels of the channel numbers 0 to 7 will be called tone generation channels 0 to 7, respectively, hereinafter.

Registers which constitute the registers 16 of the electronic musical instrument will be listed below in an alphabetical order. Note that in the following description, each register and its contents (e.g., data) are represented by the same label name unless otherwise specified.

1. ASS: An assignable sequencer number. The ASS is a 4-bit register, and the four bits correspond to the sequencers 0, 1, 2, and 3 from the LSB. Bit value 1 represents an assignable state. Note that when tone generation assignment is to be performed, a sequencer in a play mode or an automatic performance mode is excluded, and that in a recording mode is selected.

2. BS: A flag representing whether the tone generation channel 7 (sequencer 3) is in an auto bass mode. Value 1 represents the auto bass mode.

3. CHD: A flag representing whether the tone generation channels 0 to 3 (sequencer 0) are in an auto chord mode. Value 1 represents the auto chord mode.

4. CLK: A tempo clock having values from 0 to 95.

5. ENCH: An assignable tone generation channel corresponding to a sequencer selected by the register ASS. The ENCH is an 8-bit register, and the eight bits correspond to the tone generation channels 0 to 7 from the LSB. Bit value 1 represents an assignable state.

6. i and j: Control variables for sequentially checking the sequencers 0 to 3 or the tone generation channels 0 to 7.

7. KC: A key code of an event key having values 0 and 24 to 84. Note that 0 represents rest data and 24 to 84 represent key codes of the keyboard corresponding to pitches shown in Table 2.

TABLE 2

| | |
|---|---|
| Pitch | $C_1 \ldots C_2 \ldots C_3 \ldots C_4 \ldots C_5 \ldots A_5 \ldots B_5 \ldots C_6$ |
| Key Code | 24 . . . 36 . . . 48 . . . 60 . . . 72 . . . 82 . . . 83 . . . 84 |

8. KEYBUF: A key code buffer. Key codes stored in the buffer are actually generated by the tone generator 26. The key code buffer is provided for each tone generation channel. That is, key code buffers corresponding to the tone generation channels 0 to 7 are represented by $KEYBUF_0$ to $KEYBUF_7$, respectively.

9. KON: A key depression state of each tone generation channel. The KON is an 8-bit register, and the eight bits correspond to the tone generation channels 0 to 7 from the LSB. Bit value 1 represents that a key is depressed.

10. MODP: A flag representing whether each sequencer is in the play mode. The MODP is a 4-bit register, and the four bits correspond to the sequencers 0, 1, 2, and 3 from the LSB. Bit value 1 represents that the sequencer is in the play mode.

11. MODR: A flag representing whether each sequencer is in the REC mode. The MODR is a 4-bit register, and the four bits correspond to the sequencers 0, 1, 2, and 3 from the LSB. Bit value 1 represents the sequencer is in the REC mode.

2. MSK: A sequencer number which is inhibited to be assigned. The MSK is a 4-bit register, and the four bits correspond to the sequencers 0, 1, 2, and 3 from the LSB. Bit value 1 represents the sequencer is inhibited to be assigned.

13. PBS: A flag representing whether a written sequencer is in the auto bass mode. Value 1 represents the auto bass mode.

14. PCHD: A flag representing whether the written sequencer 0 is in the auto chord mode. Value 1 represents the auto chord mode.

15. $PNT_0$ to $PNT_3$ Read/write pointers for the sequencer memories $PAT_0$ to $PAT_3$, respectively.

16. RUN: A flag of rhythm run (=1)/stop (=0)/synchronous start (=−1).

17. TOUCH: Touch data obtained when a key is depressed.

Description of Functions and Operations of Electronic Musical Instrument in FIG. 1

The electronic musical instrument shown in FIG. 1 has a performance function as a normal keyboard musical instrument, an auto bass function for automatically performing a bass, an auto chord function for automatically performing a chord accompaniment, and a function of recording/reproducing an accompaniment tone and a performance tone.

In a normal mode, the performer can play the keyboard without an automatic performance of rhythm or an accompaniment. That is, when the keyboard is operated, a musical tone corresponding to the operation (key on) is generated.

In the electronic musical instrument shown in FIG. 1, when any of the SEQ switches 42 to 48 is turned on, a corresponding sequencer is set in the play mode. When any of the SEQ switches 42 to 48 and the REC switch 50 are simultaneously turned on, a corresponding sequencer is set in the REC mode. (Such mode switching will be described in detail later in a description of sequencer switch processing.)

When the electronic musical instrument is running, these modes cannot be switched. When any of the sequencers is set in the REC mode or a performance in the REC mode is finished, a synchronous start standby mode is automatically set.

When the electronic musical instrument is running in the play mode, performance data written in the REC mode is automatically read out to generate a tone. When the electronic musical instrument is running in the REC mode, accompaniment data or performance data is written in the sequencer memory 18 in real time.

Description of Operation of Electronic Musical Instrument in FIG. 1

An operation of the electronic musical instrument shown in FIG. 1 will be described below with reference to flow charts of FIGS. 4 to 19.

When the power source of the electronic musical instrument is turned on, the CPU 10 starts operation in accordance with the control programs stored in the program memory 12. First, the CPU 10 executes processing represented by a main routine from step 100 of FIG. 4 and clock interrupt processing of FIG. 14.

1. Main Routine Processing

Figure 4:
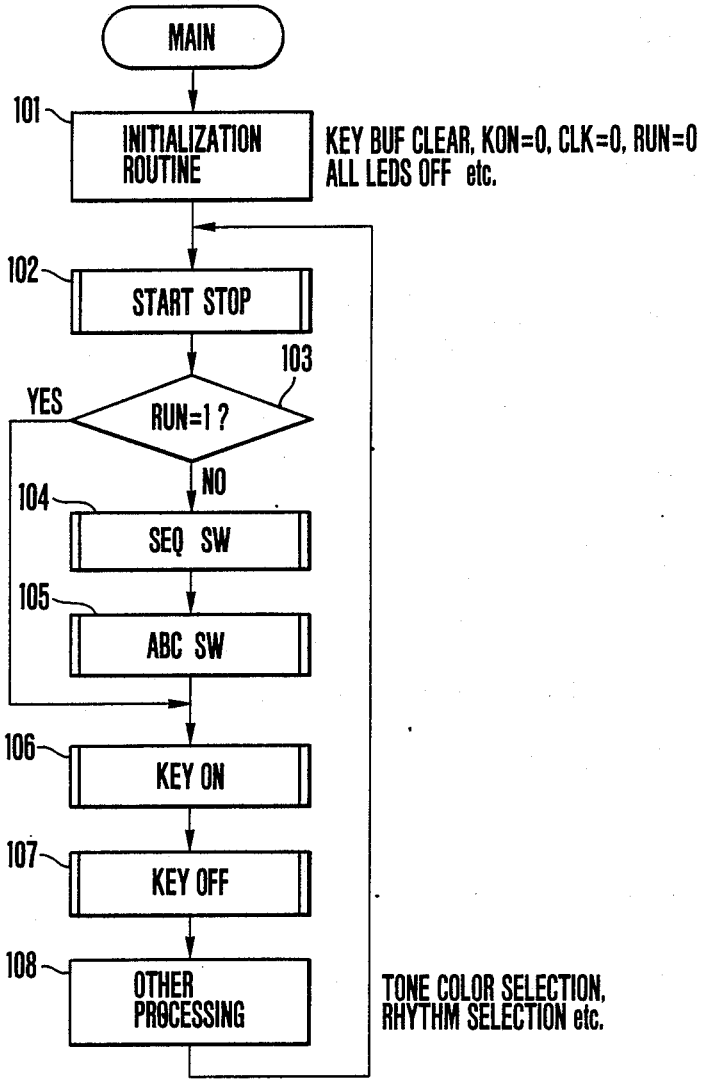
FIG. 4 is a flow chart for explaining a main routine of the electronic musical instrument in FIG. 1.

Referring to FIG. 4, initialization is performed in step 101. This initialization processing includes clear of the register KEYBUF, zero clear of the registers KON, CLK, RUN, and the like, and turning off of all LEDS, etc. Then, in step 102, depression of the S/S switch is detected, and processing (FIG. 5) is performed when it is depressed. In step 103, the CPU 10 checks whether the register RUN is 1. If N (NO) in step 103, it is determined that the apparatus is stopped or in the synchronous start standby state. Therefore, in steps 104 and 105, the CPU 10 performs sequencer switch processing (FIG. 6) and auto bass chord switch processing (FIG. 7). If Y (YES) in step 103, the apparatus is running. Therefore, the flow skips steps 104 and 105 and advances to step 106. In step 106, the CPU 10 checks the presence/absence of a key on event and performs processing (FIG. 8) if the key on event is present. In step 107, the CPU 10 checks the presence/absence of a key off event and performs processing (FIGS. 9A and 9B) if the key off event is present. In step 108, other processing such as tone color selection and rhythm selection are performed, and then the flow returns to step 102.

Processing of each subroutine will be described below.

2. Start/Stop Switch Processing

The S/S switch repeats start and stop whenever it is depressed so as to run the stopped apparatus or stop the running apparatus. In an S/S switch processing subroutine START/STOP, the presence/absence of depression of the S/S switch is detected, and processing is performed when depression is detected.

Figure 5:
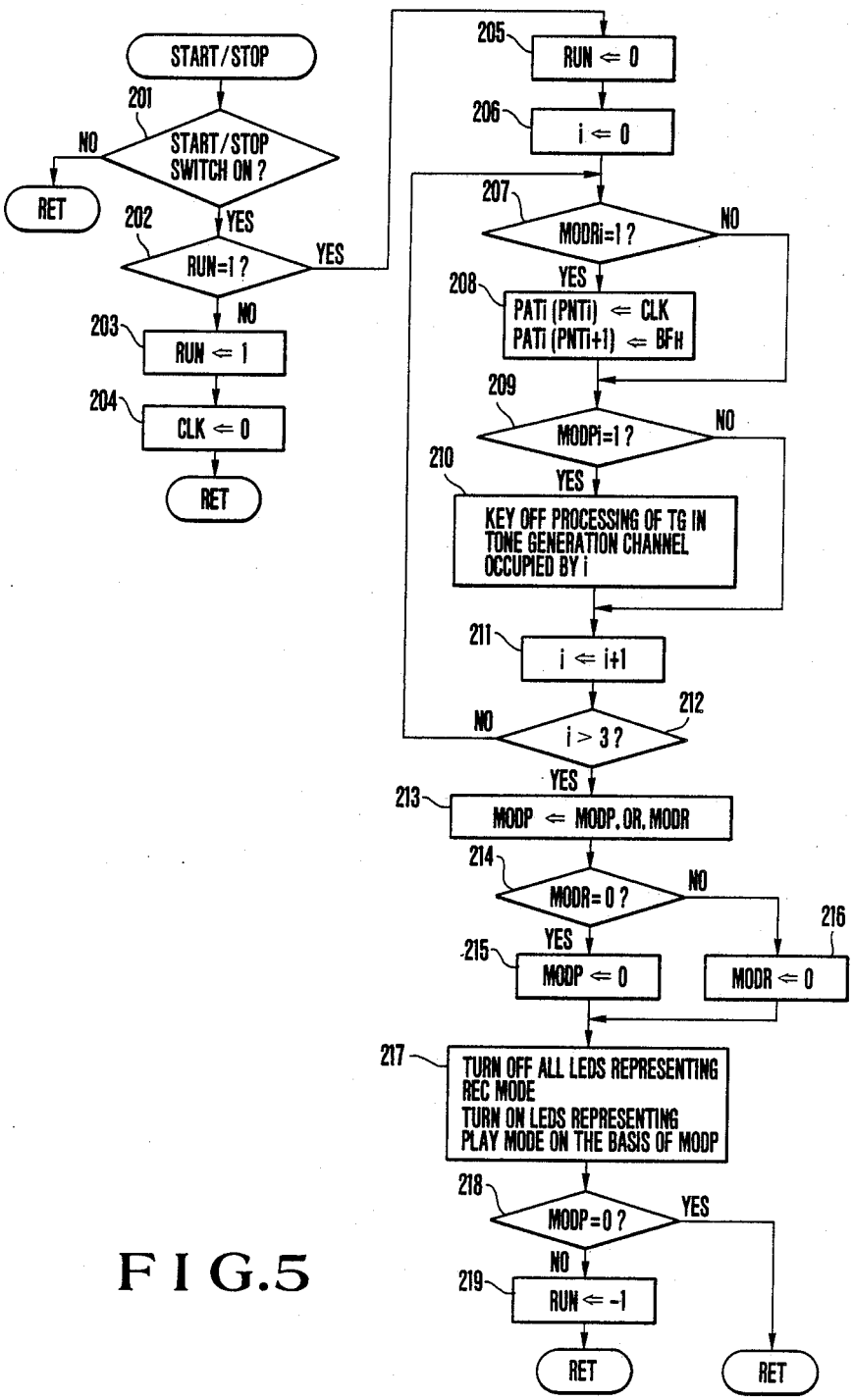
FIG. 5 is a flow chart for explaining a start/stop switch processing routine of the electronic musical instrument in FIG. 1.

Referring to FIG. 5, the CPU 10 checks in step 201 whether the S/S switch is turned on. If N in step 201, the flow returns. If Y in step 201, the flow advances to step 202. In step 202, the CPU 10 checks whether the register RUN is 1. If N in step 202, it is determined that the apparatus is stopped or in the synchronous start standby state. Therefore, in order to run the apparatus, 1 (run) is set in the register RUN in step 203, 0 is set in the tempo clock CLK in step 104, and then the flow returns. Meanwhile, if Y in step 202, the apparatus is running. Therefore, in order to stop the apparatus, 0 is set in the register RUN in step 205.

Then, in steps 206 to 212, an end code is written in any of the four sequencers set in the REC mode, and if the sequencer is set in the play mode, key off processing of the tone generator 26 is performed in a corresponding tone generation channel. That is, i is set to be 0 in step 206. Then, in step 207, the CPU 10 checks whether the register $MODR_i$ is 1. If Y in step 207, a sequencer i (which is a sequencer having a sequencer number i) is in the REC mode. Therefore, a value of the tempo clock CLK is stored in a position of the sequencer memory $PAT_i$ designated by the read/write pointer $PNT_i$, the BFH is stored in the next area, and then the flow advances to step 209. If N in step 207, the flow directly advances to step 209. In step 209, the CPU 10 checks whether the register $MODP_i$ is 1. If Y in step 209, the sequencer i is in the play mode. Therefore, the key off processing of the tone generator 26 is performed in a tone generation channel occupied by the number i, and the flow advances to step 211. If N in step 209, the flow directly advances to step 211. In step 211, the register i is incremented by one. In step 212, the CPU 10 checks whether the value of the register i exceeds 3. If N in step 212, the flow returns to step 207 to perform processing for the next sequencer i. When processing for all the four sequencers is finished, the flow advances from step 212 to 213. In step 213, an 0R of the registers MODP and MODR is obtained and stored in the register MODP. As a result, the sequencer in the REC mode is set in the play mode. That is, when the apparatus runs while a certain sequencer is in the REC mode and then the S/S switch is depressed to set the apparatus in the synchronous start standby mode, the sequencer set in the REC mode is automatically set in the play mode, and a performance recorded immediately before mode switching can be reproduced immediately.

Then, in step 214, the CPU 10 checks whether the register MODR is 0. If Y in step 214, 0 is stored in the register MODP in step 215. If N in step 214, 0 is stored in the register MODR. That is, if no sequencers are in the REC mode, the play mode of all the sequencers is released. Meanwhile, if at least one sequencer is in the REC mode, the sequencer is forcibly set in the play mode in step 213. Therefore, the REC mode of all the sequencers is released.

Then, in step 217, LEDs representing the REC mode are turned off, and those representing the play mode are turned on or off on the basis of the register MODP. In step 218, the CPU 10 checks whether a sequencer in the play mode is present, i.e., whether the register MODP is 0. If Y in step 218, the flow directly returns. If N in step 218, at least one sequencer is in the play mode. Therefore, −1 is stored in the register RUN to set the synchronous start standby state, and then the flow returns.

3. Sequencer Switch Processing

The SEQ switches 42 to 48 are depressed to select a sequencer in the play or REC mode or to release these modes. In the SEQ switch processing subroutine SEQ SW, depression of the SEQ switch of each sequencer is detected, and processing is performed when the SEQ switch is depressed.

Figure 6:
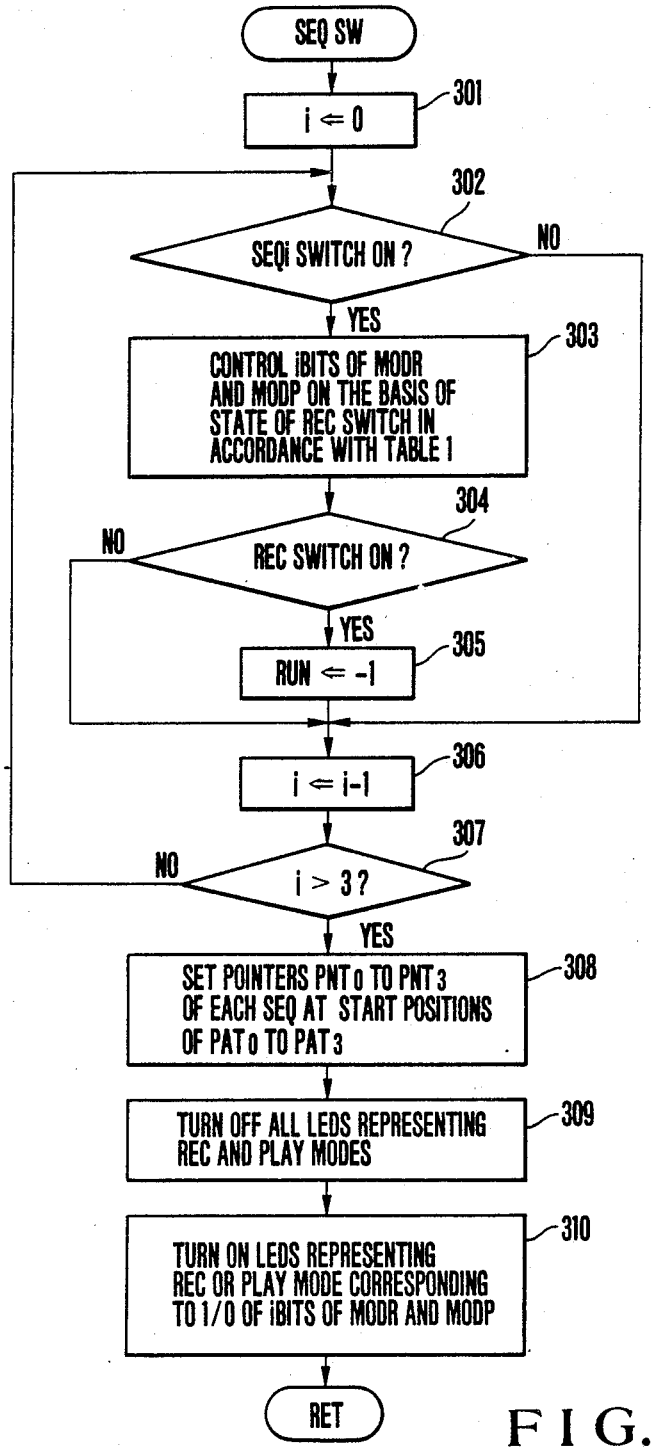
FIG. 6 is a flow chart for explaining a sequencer switch processing routine of the electronic musical instrument in FIG 1.
Figure 7:
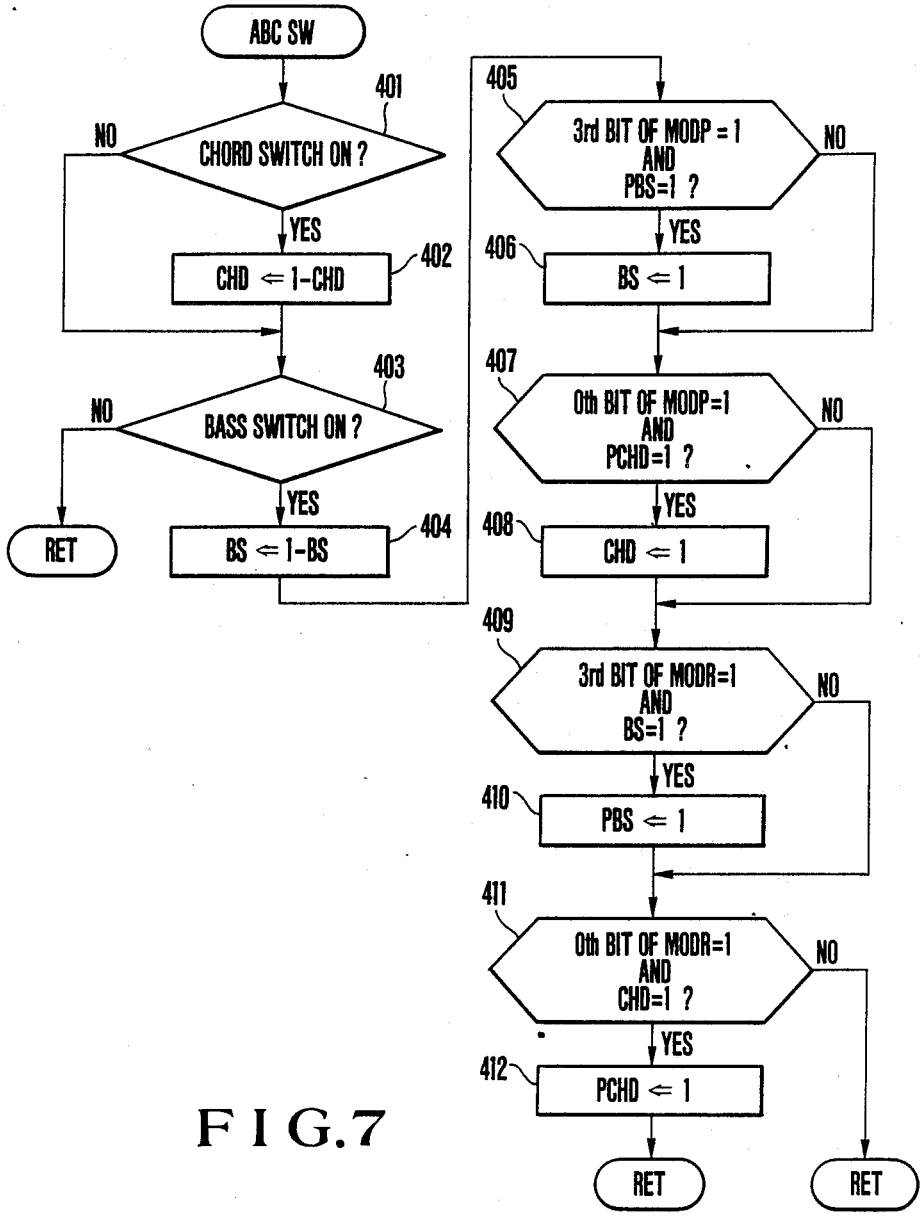
FIG. 7 is a flow chart for explaining an auto bass chord switch/processing routine of the electronic musical instrument in FIG. 1.

Referring to FIG. 6, 0 is stored in the register i in step 301. Then, in step 302, the CPU 10 checks whether an SEQ switch $SEQ_i$ of the sequencer number i is turned on. If Y in step 302, i bits cf the registers MODR and MODP are controlled on the basis cf a state of the REC switch in accordance with Table 3 in step 303.

TABLE 3

| | Old State | | New State | |
|---|---|---|---|---|
| REC Switch | $MODR_i$ | $MODP_i$ | $MODR_i$ | $MODP_i$ |
| ON | 0 | 0 | 0 | 1 |
| | 0 | 1 | 0 | 0 |
| | 1 | 0 | 0 | 0 |
| OFF | 0 | 0 | 1 | 0 |
| | 0 | 1 | 1 | 0 |
| | 1 | 0 | 1 | 0 |

Note that the REC switch is ON when the SEQ switch is turned on while the REC switch is depressed, and the REC switch is OFF when only the SEQ switch is turned on while the REC switch is not depressed.

In step 304, the CPU 10 checks whether the REC switch is ON. If Y in step 304, −1 is stored in the register RUN to set the synchronous start mode. If N in step 304, the flow directly advances to step 306. Note that if the $SEQ_i$ switch is not turned on in step 302, the flow advances to step 306. In step 306, the register i is incremented by one. In step 307, the CPU 10 checks whether the value of the register 3 exceeds three. If N in step 307, the flow returns to step 302, and similar processing is performed for the next sequencer number i. When processing for all the four sequencers is finished, the flow advances to step 308.

In step 308, the pointers $PNT_0$ to $PNT_3$ of the sequencers are set at start positions of the sequencer memories $PAT_0$ to $PAT_3$, respectively. Then, in step 309, LEDs representing the REC and play modes are turned off. In step 310, LEDs representing the REC or play mode corresponding to 1 or 0 of the i bits of the registers MODR and MODP are turned on. Thereafter, the flow returns.

4. Auto Bass Chord Switch Processing

The auto bass switch 54 is depressed to select or release the auto bass mode for automatically performing a bass. The auto chord switch 52 is depressed to select or release the auto chord mode for automatically performing chord accompaniment. In the auto bass chord switch processing subroutine ABCSW, depression of each switch is detected, and the processing is performed when the switch is depressed.

Referring to FIG. 7, in step 401, the CPU 10 checks whether the CHORD switch is turned on. If Y in step 401, a result of 1−CHD is stored in the register CHD in step 402. As a result, the register CHD is set to be 1 when it is originally 0 and set to be 0 when it is originally 1. If N in step 401, the flow advances to step 403.

In step 403, the CPU 10 checks whether the BASS switch is turned on. If N in step 403, the flow directly returns. If Y in step 403, a result of 1−BS is stored in the register BS in step 404. As a result, the register BS is set to be 1 when it is originally 0 and set to be 0 when it is originally 1.

Then, in step 405, the CPU 10 checks whether the third bit (sequencer 3) of the register MODP is 1 and the register PBS is 1. If Y in step 405, 1 is stored in the register BS, and the flow advances to step 407. If N in step 405, the flow directly advances to step 407. In step 407, the CPU 10 checks whether the 0th bit of the register MODP is 1 and the register PCHD is 1. If Y in step 409, 1 is stored in the register CHD, and the flow advances to step 409. If N in step 407, the flow directly advances to step 409. In step 409, the CPU checks whether the third bit of the register MODR is 1 and the register BS is 1. If Y in step 409, 1 is stored in the register PBS, and the flow advances to step 411. If N in step 409, the flow directly advances to step 411. In step 411, the CPU 10 checks whether the 0th bit of the register MODR is 1 and the register CHD is 1. If Y in step 411, 1 is stored in the register PCHD, and the flow returns. If N in step 411, the flow directly returns.

5. Key On Event Processing

In the key on processing subroutine KEYON, the processing is performed when ON of a key of the keyboard is detected.

Figure 8:
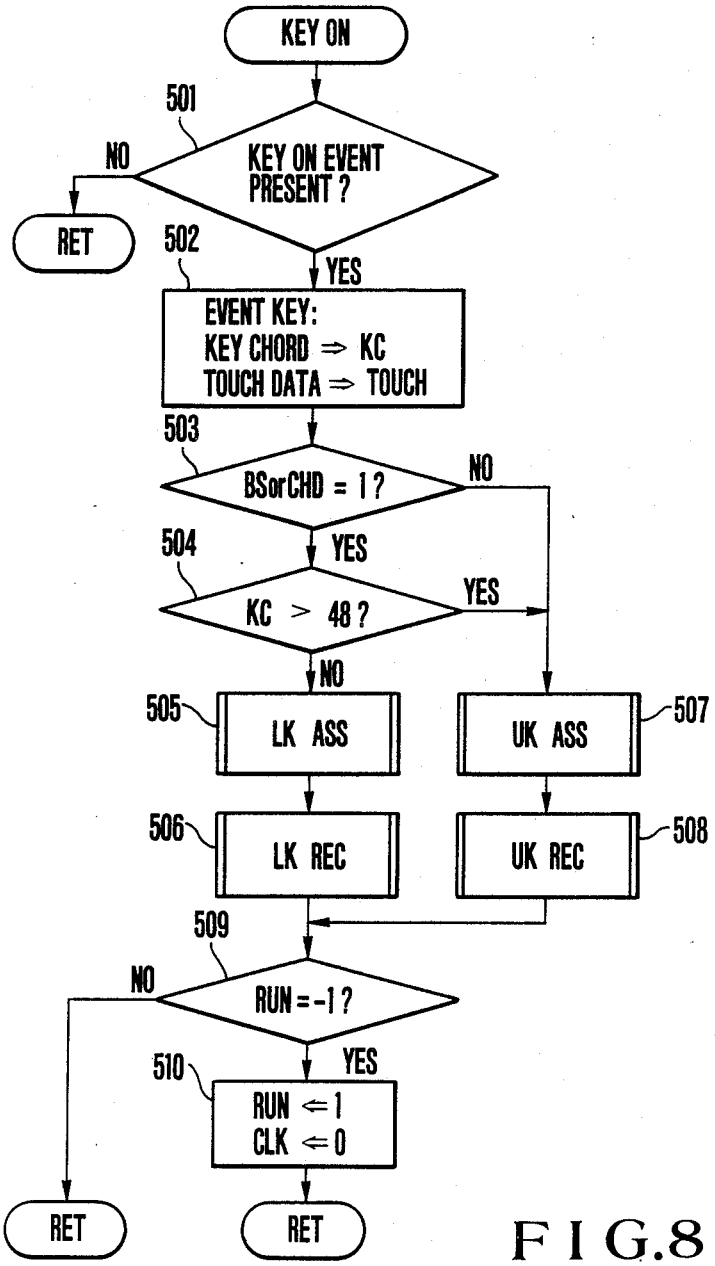
FIG. 8 is a flow chart for explaining a key on event processing routine of the electronic musical instrument in FIG. 1.

Referring to FIG. 8, in step 501, the CPU 10 checks whether a key on event is present. If N in step 501, the flow directly returns. If Y in step 501, the flow advances to step 502. In step 502, a key code of a key corresponding to the key on event is stored in the register KC, and touch data is stored in the register TOUCH. Then, in step 503, the CPU 10 checks whether the register BS or CHD is 1, i.e., whether the auto bass mode or auto chord mode is set. If Y in step 503, the CPU 10 checks the register KC in step 504 to check whether the key code of the depressed key exceeds 48. If N in step 503, all the keys are used as melody keys. Therefore, the flow advances to step 507. If Y in step 504, the depressed key is a melody key, and therefore the flow advances to step 507. If N in step 504, the depressed key is a key for accompaniment. Therefore, a tone generation channel is assigned in step 505, and the write processing in the REC mode is performed in step 506. Processing operations in steps 505 and 506 are performed in accordance with subroutines to be described later.

In step 507, a tone generation channel assignment to be performed when a melody key is depressed is performed. In step 508, the write processing in the REC mode is performed. Then, in step 509, the CPU 10 checks whether the register RUN is −1, i.e., whether the synchronous start mode is set. If Y in step 509, 1 is stored in the register RUN in step 510, 0 is stored in the tempo clock CLK, and then the flow returns.

6. Key Off Event Processing

In the key off event processing KEYOFF, the processing is performed when OFF of an ON key of the keyboard is detected.

Figures 9A, 9B:
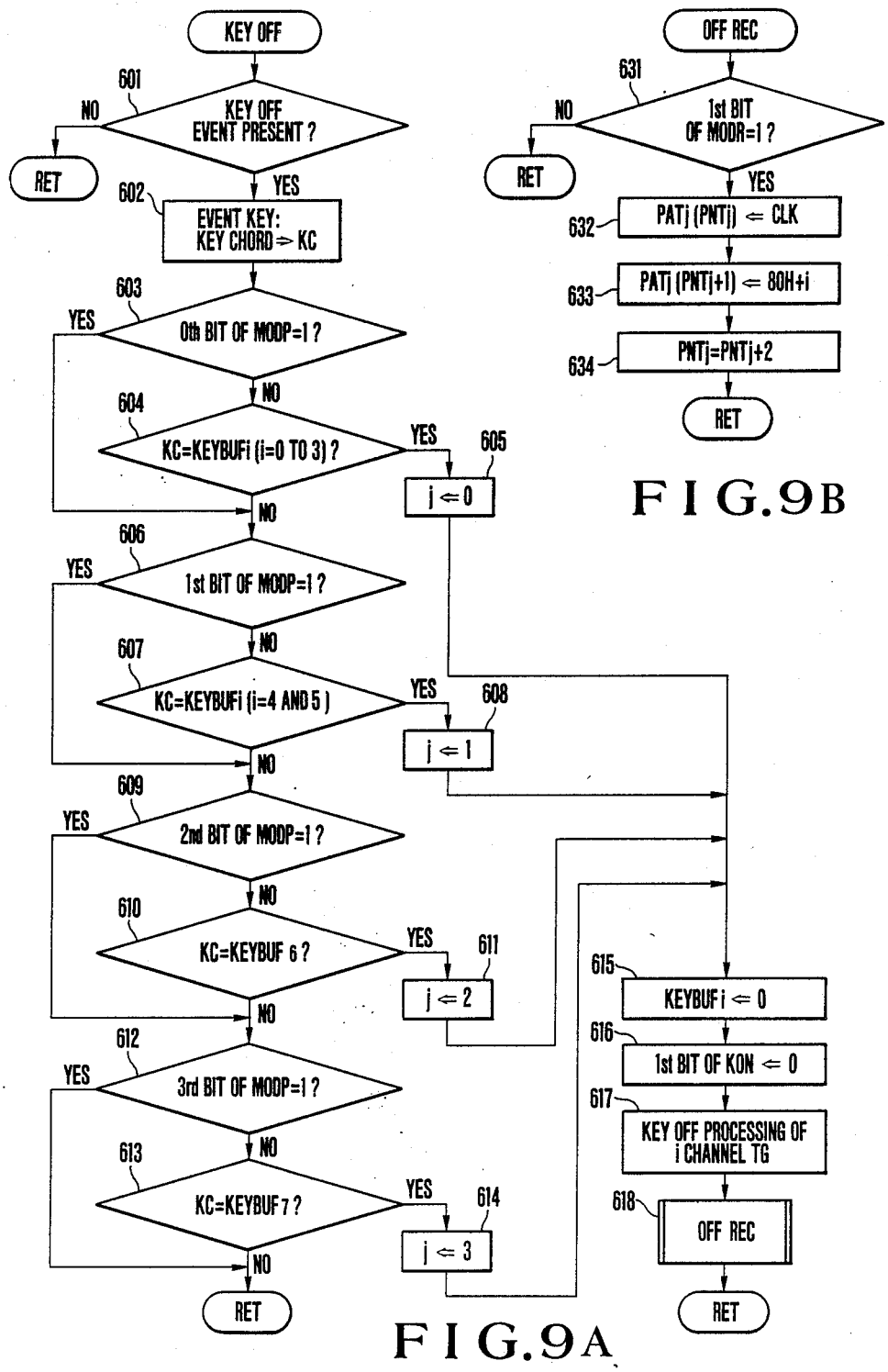
FIGS. 9A and 9B are flow charts for explaining a key off event processing routine of the electronic musical instrument in FIG. 1.

Referring to FIG. 9A, in step 601, the CPU 10 checks whether a key off event is present. If N in step 601, the flow directly returns. If Y in step 601, a key code of the event key is stored in the register KC in step 602. Then, in step 603, the CPU 10 checks whether the 0th bit of the register MODP is 1, i.e., whether the tone generation channels 0 to 3 are assigned to the play mode. If N in step 603, the CPU 10 compares key codes generated in the tone generation channels of i=0 to 3, i.e., key codes stored in the $KEYBUF_i$ with the key code KC corresponding to the key off event and checks whether a coincident key code is present in step 604. If Y in step 604, the key off event is present on the key corresponding to the key code generated in the tone generation channel i. Therefore, 0 is stored in the register j, and then the flow advances to step 615.

If Y in step 603, the key off processing need not be performed, and therefore the flow advances to step 606. If no key code in the $KEYBUF_i$ (i=0 to 3) coincides with the key code KC corresponding to the key off event in step 604, the flow also advances to step 606.

In steps 606 to 608, 609 to 611, and 612 to 614, similar processing as in steps 603 to 605 is performed for sequencers of the sequencer numbers 1, 2, and 3, respectively.

In step 606, the CPU 10 checks whether the first bit of the register MODP is 1. If Y in step 606, the sequencer 1 is in the play mode, and the flow advances to step 609. If N in step 606, the CPU checks in step 607 whether the $KEYBUF_i$ in tone generation channels of i=4 and 5 corresponding to the sequencer 1 coincides with the key code KC. If Y in step 607, it is determined that the key is turned off. Therefore, 1 is stored in the register j in step 608, and the flow advances to step 615. If N in step 607, the flow advances to step 609.

In steps 609 to 611, the CPU 10 checks whether the key off event is present with respect to the sequencer number 2 and the tone generation channel 6. If the key off event is present, 2 is stored in the register j in step 611, and the flow advances to step 615. If the key off event is not present, the flow advances to step 612.

In steps 612 to 614, the CPU 10 checks whether the key off event is present with respect to the sequencer number 3 and the tone generation channel 7. If the key off event is present, 3 is stored in the register j in step 614, and the flow advances to step 615. If the key off event is not present, the flow directly returns. Note that when the flow directly returns from step 613, the key off event is present on a key which is not generating a tone. This is because the number of tone generation channels is limited to eight, and therefore, sometimes, a tone generation channel is not assigned and a tone is not generated even if a key is depressed.

In step 615, the code $KEYBUF_i$ corresponding to the tone generation channel i of the key code buffer which generates a tone is cleared to be 0. In step 616, in order to release the key depression state of the i channel, the ith bit of the register KON is cleared to be 0. Then, in step 617, key off processing of the tone generator 26 of the i channel is performed. In step 618, a subroutine OFFREC (FIG. 9B) is called, and the flow returns.

Referring to FIG. 9B showing the subroutine OFFREC, in step 631, the CPU 10 checks whether the jth bit of the register MODR is 1, i.e., whether a sequencer of the sequencer number j is set in the REC mode. If N in step 631, the flow returns. If Y in step 631, in order to write information about the key off event in the sequencer memory 18, the flow advances to step 632. In step 632, the tempo clock CLK is stored in a position of the pointer $PNT_j$ of the sequencer memory $PAT_j$. In step 633, 80H+i is stored in a position next to the above position. In step 634, 2 is added to the pointer $PNT_j$. Thereafter, the flow returns.

7. Accompaniment Key Assignment Processing

The accompaniment key assignment processing subroutine LKASS is called from the key on event processing subroutine KEYON (FIG. 8) when the auto bass or auto chord accompaniment is performed and a key having a pitch of $C_3$ or less is depressed. In this processing, assignment for generating a tone is performed.

Figure 10:
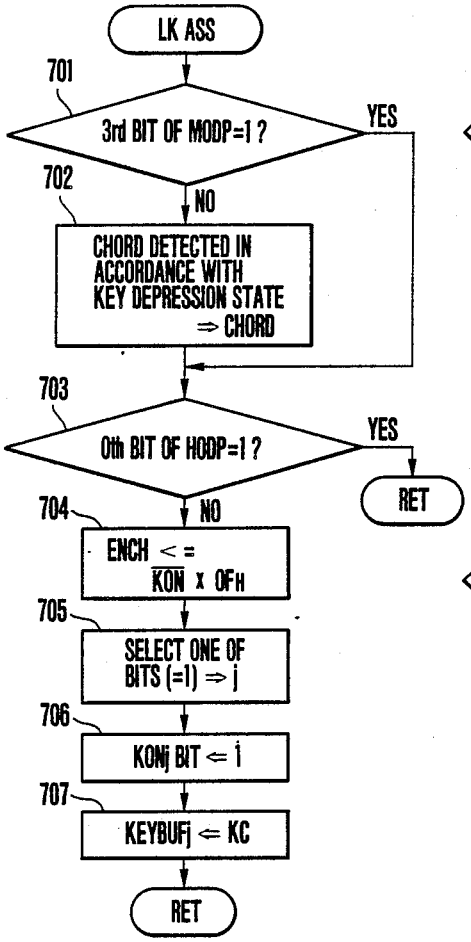
FIG. 10 is a flow chart for explaining an accompaniment key assignment processing routine of the electronic musical instrument in FIG. 1.

Referring to FIG. 10, in step 701, the CPU 10 checks whether the third bit of the register MODP is 1, i.e., whether the sequencer 3 is in the play mode. If Y in step 701, a tone is generated on the basis of data written in the sequencer. Then, since a key depression state need not be checked, the flow directly advances to step 703. If N in step 701, a chord is detected in accordance with a key depression state and stored in the register CHORD in step 702, and the flow advances to step 703.

In step 703, the CPU 10 checks whether the 0th bit of the register MODP is 1, i.e., whether the sequencer 0 is in the play mode. If Y in step 703, since a tone is generated in accordance not with the key depression data but with the data written in the sequencer, the flow directly returns. If N in step 703, inverted data $\overline{KON}$ of the register KON and the OFH are ANDed in step 704. Since the KON represents a key depression state of each tone generation channel, 1 is set at a position of an assignable tone generation channel of the $\overline{KON}$. In order to find a tone generation channel from the above assignable tone generation channels 0 to 3 corresponding to the sequencer 0, the data $\overline{KON}$ is ANDed with OFH. In step 705, one of bits (=1) of the register ENCH representing an assignable tone generation channel is selected, and the number of the channel is stored in the register j. In step 706, the jth bit of the register KON is set to be 1 in order to represent that the tone generation channel of the channel j is assigned. In step 707, in order to generate a tone of the key code KC of the depressed key, the key code KC is stored in the key code buffer $KEYBUF_j$, and the flow returns.

8. Accompaniment Key Write Processing

After the above accompaniment key assignment processing, writing in the sequencer is performed when an accompaniment key is depressed in the REC mode in the accompaniment key write processing.

Figure 11:
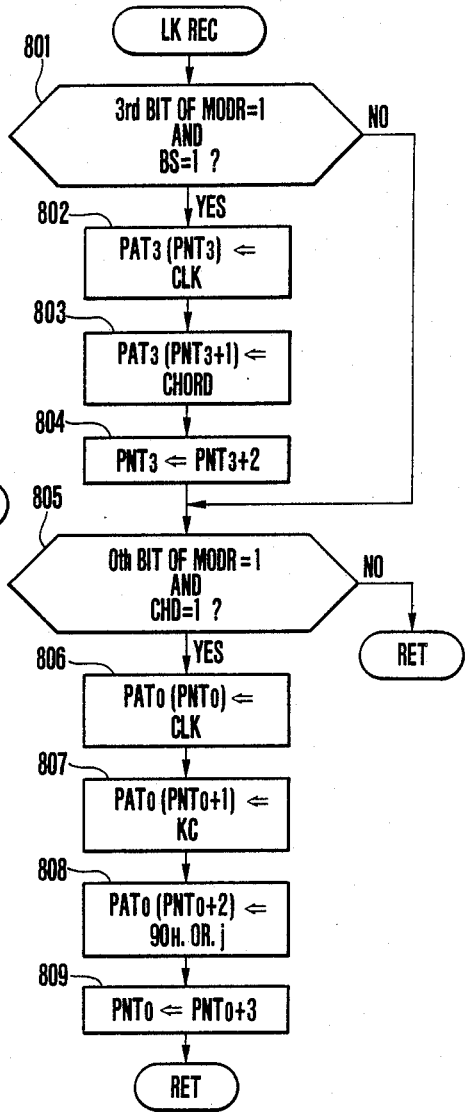
FIG. 11 is a flow chart for explaining an accompaniment key write processing routine of the electronic musical instrument in FIG. 1.

Referring to FIG. 11, in step 801, the CPU checks whether the third bit of the register MODR is 1 and the register BS is 1, i.e., whether the sequencer 3 (channel 7) is in the REC mode and the auto bass mode. If Y in step 801, the tempo clock CLK is stored in a position of the sequencer memory $PAT_3$ represented by the pointer $PNT_3$ in step 802. In step 803, the content of the register CHORD, i.e., a chord detected in accordance with the key depression state is stored in a position next to the above position. Then, in step 804, the pointer $PNT_3$ is updated, and the flow advances to step 805. If N in step 801, writing need not be performed. Therefore, the flow advances to step 805.

In step 805, the CPU 10 checks whether the 0th bit of the register MODR is 1 and the register CHD is 1, i.e., whether the sequencer 0 (channels 0 to 3) is in the REC mode and the channels 0 to 3 are in the auto chord mode. If Y in step 805, the value of the tempo clock CLK is stored in a position of the sequencer memory $PAT_0$ represented by the pointer $PNT_0$ in step 806. In step 807, the value of the key code KC of the depressed key is stored in a position next to the above position. In step 808, a value obtained by ORing 90H and the register j is stored in a position next to the above position. Note that the register j already stores the number of a tone generation channel to be assigned in step 705 of FIG. 10. Then, in step 809, the pointer $PNT_0$ is updated, and the flow returns. If N in step 805, the flow directly returns.

9. Melody Key Assignment Processing

The melody key assignment processing subroutine UKASS is called in the key on event subroutine KEYON (FIG. 8) when neither of the auto bass mode and the auto chord mode are set (at this time, all the keys are used as melody keys) or when a pitch of a depressed key is higher than $C_3$ even in such an automatic accompaniment mode. In this subroutine, the tone generation channel assignment processing and the tone generation processing of the tone generator 26 are performed.

Figure 12:
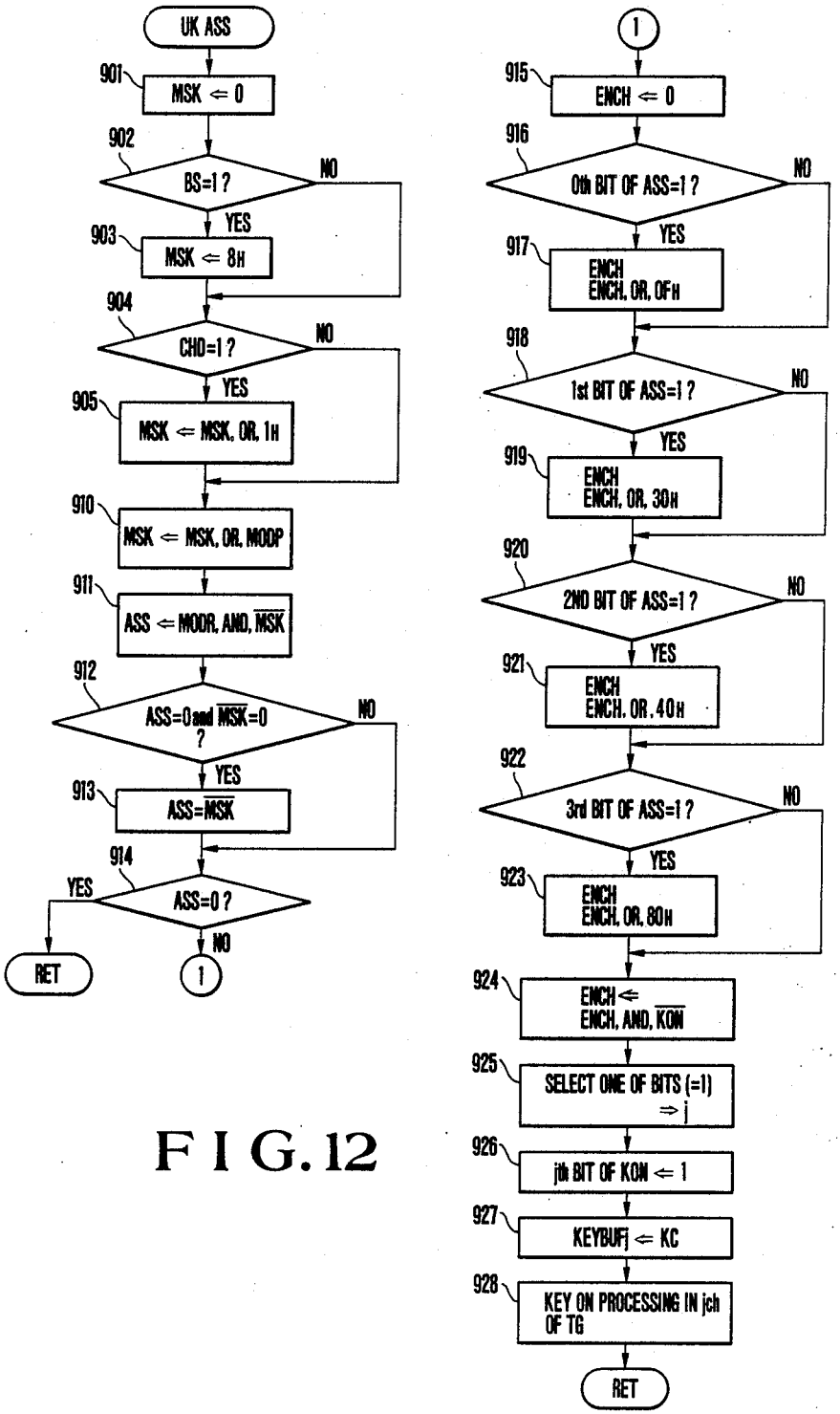
FIG. 12 is a flow chart for explaining a melody key assignment processing routine of the electronic musical instrument in FIG 1.

Referring to FIG. 12, in step 901, the register MSK is cleared to be 0. Then, in step 902, the CPU 10 checks whether the auto bass mode is set. If Y in step 902, the sequencer 3 is assigned for automatic bass accompaniment. Therefore, in order to mask a bit position of the register MSK corresponding to the sequencer 3, 8H is stored in the register MSK in step 903. Thereafter, the flow advances to step 904. If N in step 902, the flow directly advances to step 904.

In step 904, the CPU 10 checks in accordance with the register CHD whether the auto chord mode is set. If Y in step 904, the sequencer 0 is assigned for automatic chord accompaniment. Therefore, in order to mask a bit position of the register MSK corresponding to the sequencer 0, the register MSK and 1H are ORed in step 905 and the 0R value is stored in the register MSK. Thereafter, the flow advances to step 910. If N in step 904, the flow directly advances to step 910.

In step 910, the registers MSK and MODP are ORed and the OR value is stored in the register MSK. As a result, sequencers in the play mode are masked. Then, in step 911, the register MODR and inverted data $\overline{MSK}$ of the register MSK are ANDed and the AND value is stored in the register ASS. As a result, 1 is set in a bit position of the register ASS representing an assignable sequencer in the REC mode. In step 912, the CPU 10 checks whether the register ASS is 0 and the inverted data $\overline{MSK}$ of the register MSK is not 0. If assignable sequencers are present (i.e., $\overline{MSK} \neq 0$) but none of the assignable sequencers is in the REC mode (i.e., ASS=0), the value of $\overline{MSK}$ representing an assignable sequencer is stored in the register ASS to be assigned to a sequencer not in the REC mode in step 913, and the flow advances to step 914. If the register ASS is not 0 or the register MSK is 0, the flow advances to step 914.

In step 914, the CPU 10 checks in accordance with the register ASS whether an assignable sequencer is present. If N in step 914, the flow returns. If Y in step 914, the flow advances to step 915. In steps 915 to 925, a tone generation channel to be actually assigned is selected on the basis of the number of the assignable sequencer of the register ASS.

First, in step 915, the register ENCH is cleared to be 0. Then, in step 916, the CPU 10 checks whether the 0th bit of the register ASS is 1, i.e., whether the sequencer 0 is assignable. If Y in step 916, the registers ENCH and OFH are ORed and the OR value is stored in the register ENCH so that the tone generation channels 0 to 3 become assignable in step 917, and the flow advances to step 918. If N in step 916, the flow directly advances to step 918. In steps 918 and 919, similar processing for the sequencer 1 (tone generation channels 4 and 5) is performed. If the first bit of the register ASS is 1 in step 918, the tone generation channels 4 and 5 corresponding to the sequencer 1 are assignable. Therefore, in step 919, 1 is set in the bits of the register ENCH corresponding to the tone generation channels 4 and 5. Similarly, if the second bit of the register ASS is 1 in step 920, the tone generation channel 6 corresponding to the sequencer 2 is assignable. Therefore, in step 921, 1 is set in a bit of the register ENCH corresponding to the tone generation channel 6. If the third bit of the register ASS is 1 in step 922, the channel 7 corresponding to the sequencer 3 is assignable. Therefore, 1 is set in a bit of the register ENCH corresponding to the tone generation channel 7 in step 923. As a result, 1s are set in the bit positions of the register ENCH corresponding to the respective tone generation channels.

Then, in step 924, the register ENCH and $\overline{KON}$ are ANDed and the AND value is stored in the register ENCH. As a result, 1 is set in a bit of the register ENCH corresponding to a tone generation channel which is currently not used among the assignable tone generation channels. In step 925, one of bits (=1) of the register ENCH is selected, and the number of a tone generation channel corresponding to the bit is stored in the register j. Then, in step 926, 1 is set in the jth bit of the register KON representing a key depression state of each tone generation channel in order to represent that the tone generation channel is currently used. In step 927, the key code KC to be generated is stored in the key code buffer $KEYBUF_j$. In step 928, tone generation processing is performed in the j channel of the tone generator 26, and the flow returns.

10. Melody Key Write Processing

After the above melody key assignment processing, melody key depression in the REC mode is written in the sequencer in the melody write processing subroutine.

Figure 13:
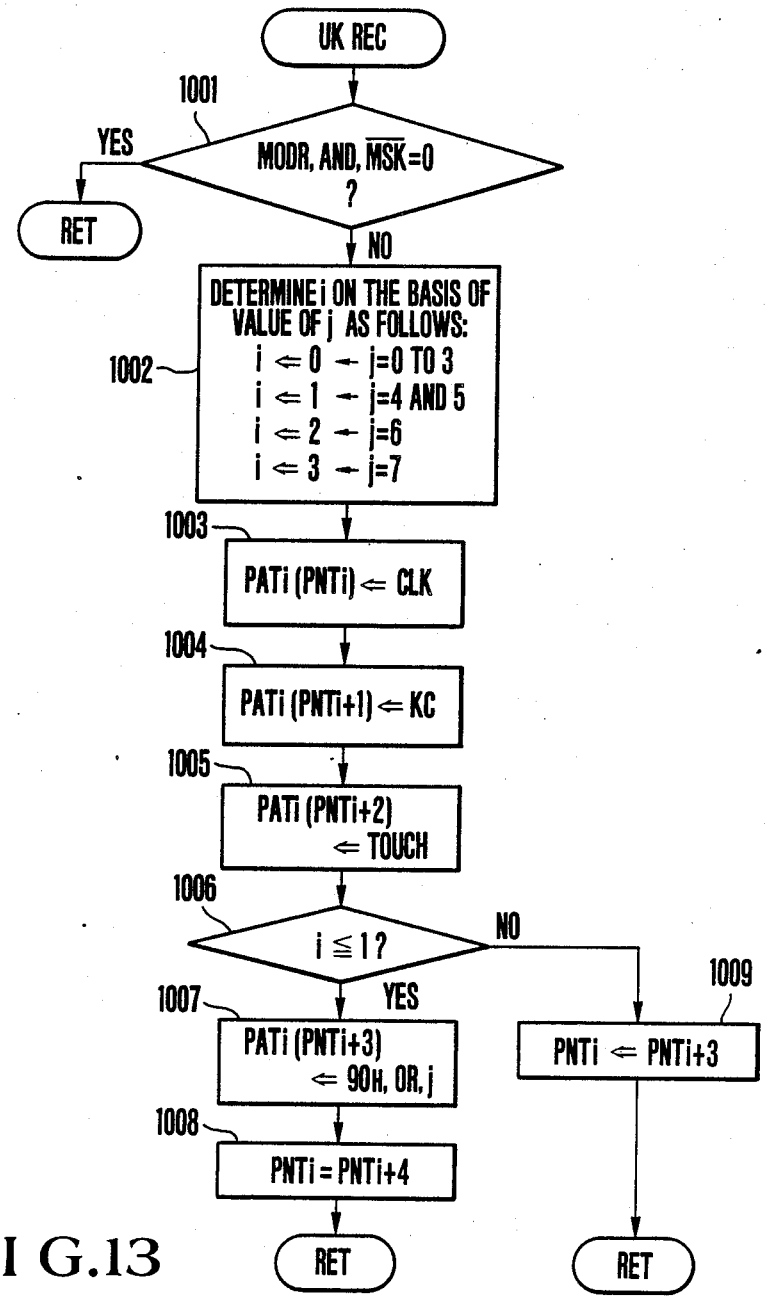
FIG. 13 is a flow chart for explaining a melody key write processing routine of the electronic musical instrument in FIG. 1.

Referring to FIG. 13, in step 1001, the registers MODR and $\overline{MSK}$ are ANDed, and the CPU 10 checks whether the AND value is 0. If the REC mode is not set or an assignable sequencer is not present, the flow directly returns because a write operation need not be performed to the sequencer memory 18. Otherwise, the register i is determined on the basis of the value of the register j as follows in step 1002:

i=0 when j=0 to 3
i=1 when j=4 and 5
i=2 when j=6
i=3 when j=7

The register j already stores the number of the tone generation channel assigned in step 925 of the above melody key assignment processing. Therefore, a sequencer number corresponding to the tone generation channel is set in the register i. Then, in step 1003, the value of the tempo clock CLK is stored in a position of the pointer $PNT_i$ of the sequencer memory $PAT_i$ of a sequencer having the tone generation channel. In step 1004, the key code KC is stored in a position next to the above position. In step 1005, the touch data TOUCH is stored in a position next to the above position. Then, in step 1006, the CPU 10 checks whether the register i is 1 or less. If Y in step 1006, tone generation channels of the sequencers 0 and 1 must be stored in the sequencer memory. Therefore, in step 1007, 90H and the register j are ORed and the OR value is stored in a position of the pointer $PNT_i+3$ of the sequencer memory $PAT_i$. In step 1008, the pointer $PNT_i$ is updated, and the flow returns. If the numbers of the written sequencers are 2 and 3 in step 1006, a tone generation channel need not be written. Therefore, the pointer $PNT_i$ is updated in step 1009, and the flow returns.

11. Clock Interrupt Processing

Figure 14:
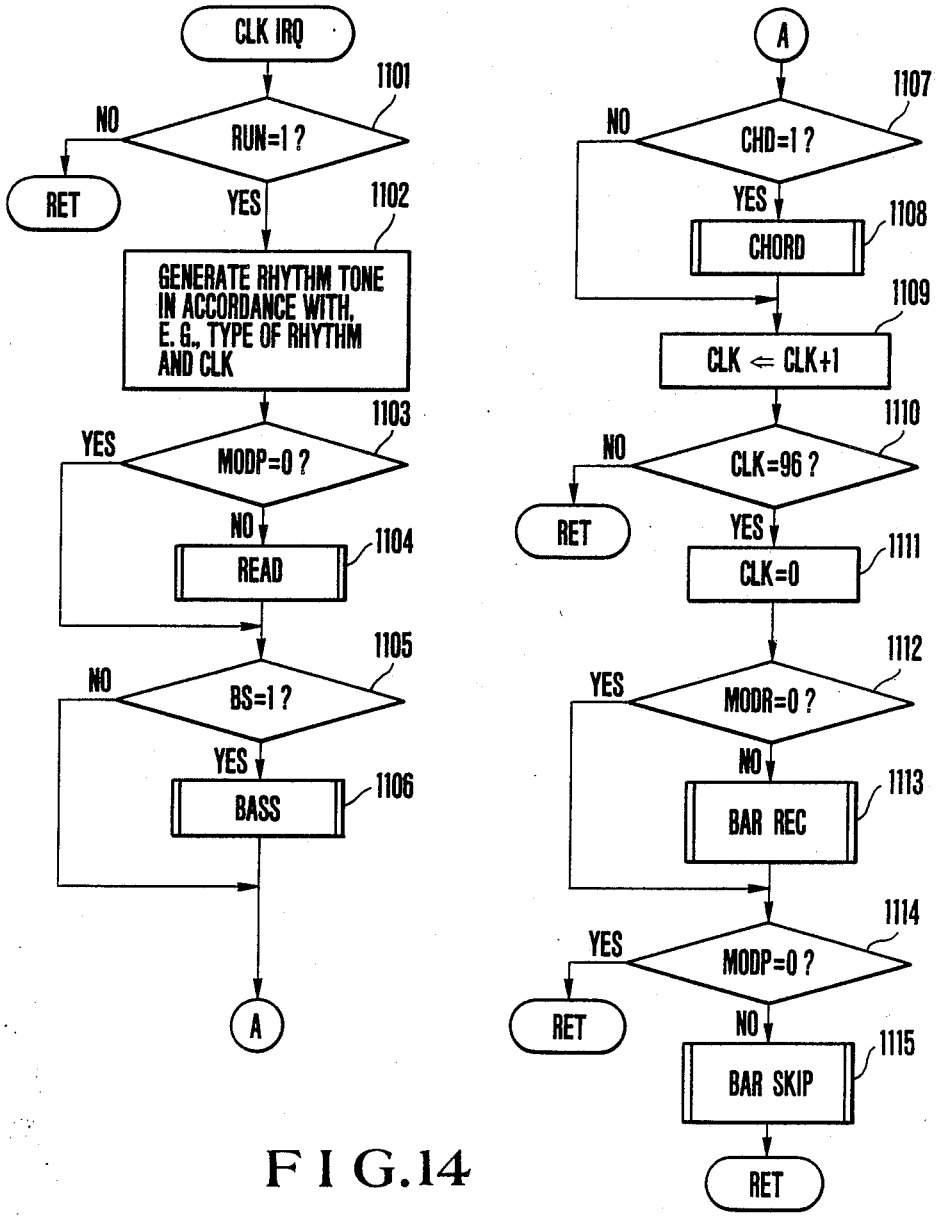
FIG. 14 is a flow chart for explaining a clock interrupt processing routine of the electronic musical instrument in FIG. 1.

In this electronic musical instrument, the clock interrupt processing shown in FIG. 14 is executed using a tempo clock output every 1/96 period of one measure from the tempo clock generator 22 as an interrupt signal.

Referring to FIG. 14, in step 1101, the CPU 10 checks whether the register RUN is 1, i.e., whether the electronic musical instrument is running. If N in step 1101, tone generation processing of rhythm, accompaniment, and a performance tone and count processing of the tempo clocks need not be performed. Therefore, interruption is immediately released, and the flow returns.

Meanwhile, if Y in step 1101, a rhythm tone is generated in accordance with the type of rhythm, the tempo clock CLK, and the like in step 1102. That is, rhythm except for bass or chord accompaniment such as a tone of cymbals or the like is generated. Then, in step 1103, the CPU 10 checks in accordance with the register MODP whether the play mode is set. If any of the sequencers is set in the play mode, a subroutine READ is called in step 1104, and the flow advances to step 1105. If none of the sequencers is set in the play mode, the flow directly advances to step 1105.

In step 1105, the CPU 10 checks in accordance with the register BS whether the auto bass mode is set. If Y in step 1105, a subroutine BASS is called in step 1106, and the flow advances to step 1107. If N in step 1105, the flow directly advances to step 1107.

In step 1107, the CPU 10 checks in accordance with the register CHD whether the auto chord mode is set. If Y in step 1107, a subroutine CHORD is called in step 1108, and the flow advances to step 1109. If N in step 1107, the flow directly advances to step 1109.

In step 1109, the tempo clock CLK is incremented. In step 1110, the CPU 10 checks whether the tempo clock CLK has reached 96, i.e., whether the end of a measure is reached. If N in step 1110, interruption is released, and the flow returns. If Y in step 1110, the tempo clock CLK is cleared to be 0 in step 1111.

Then, in step 1112, the CPU 10 checks in accordance with the register MODR whether any of the sequencers is in the REC mode. If Y in step 1112, measure end data is written by a subroutine BARREC in step 1113. In step 1114, the CPU 10 checks whether any of the sequencers is in the play mode. If Y in step 1114, a subroutine BARSKIP is called to obtain data of the next measure. If N in step 1114, interruption is released, and the flow returns.

12. Sequencer Read Processing

A sequencer read processing subroutine READ is called when a sequencer in the play mode is present in the above interrupt processing performed by the tempo clock.

Figure 15A:
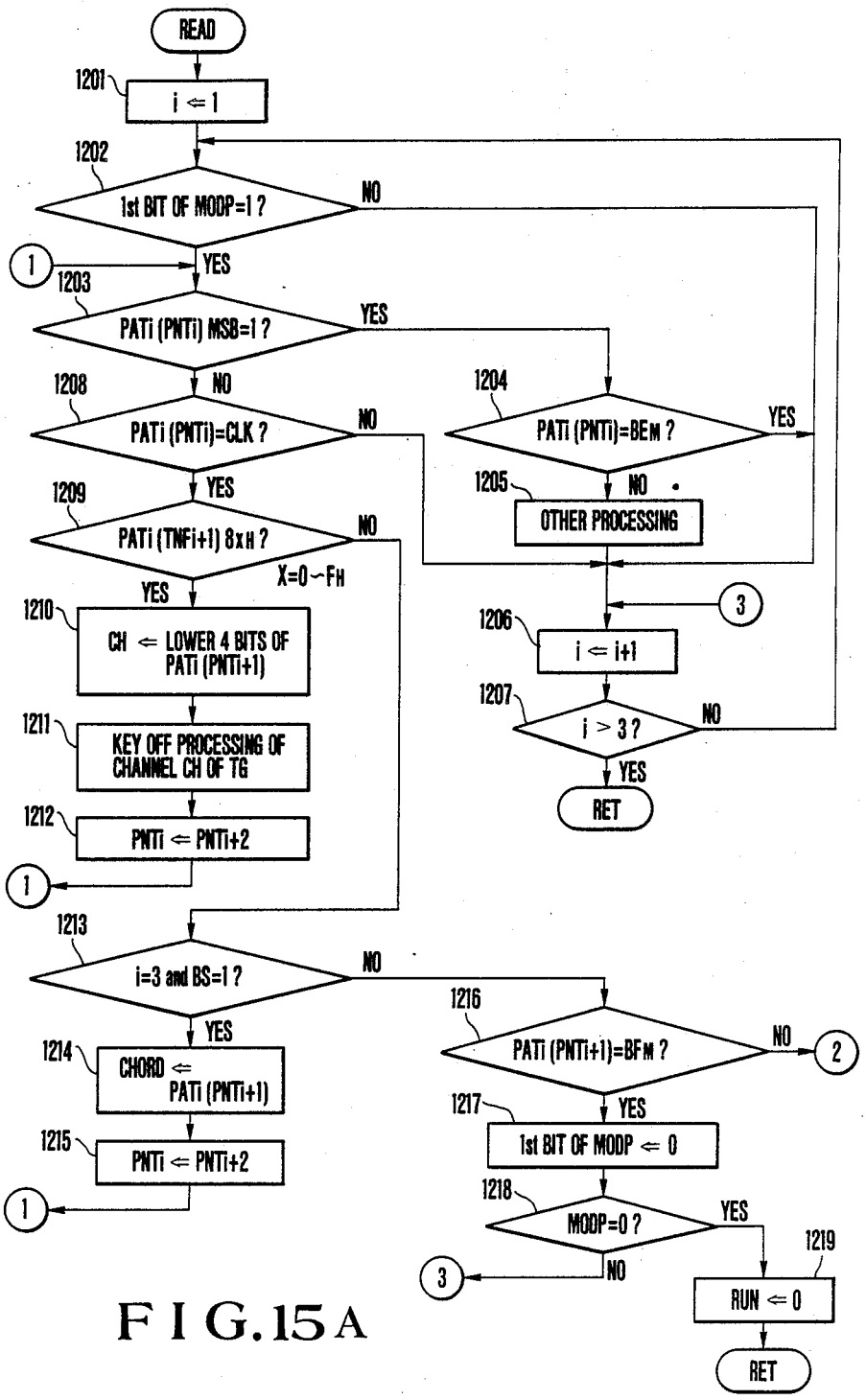
FIGS. 15A and 15B are flow charts for explaining a sequencer read processing routine of the electronic musical instrument in FIG. 1.
Figure 15B:
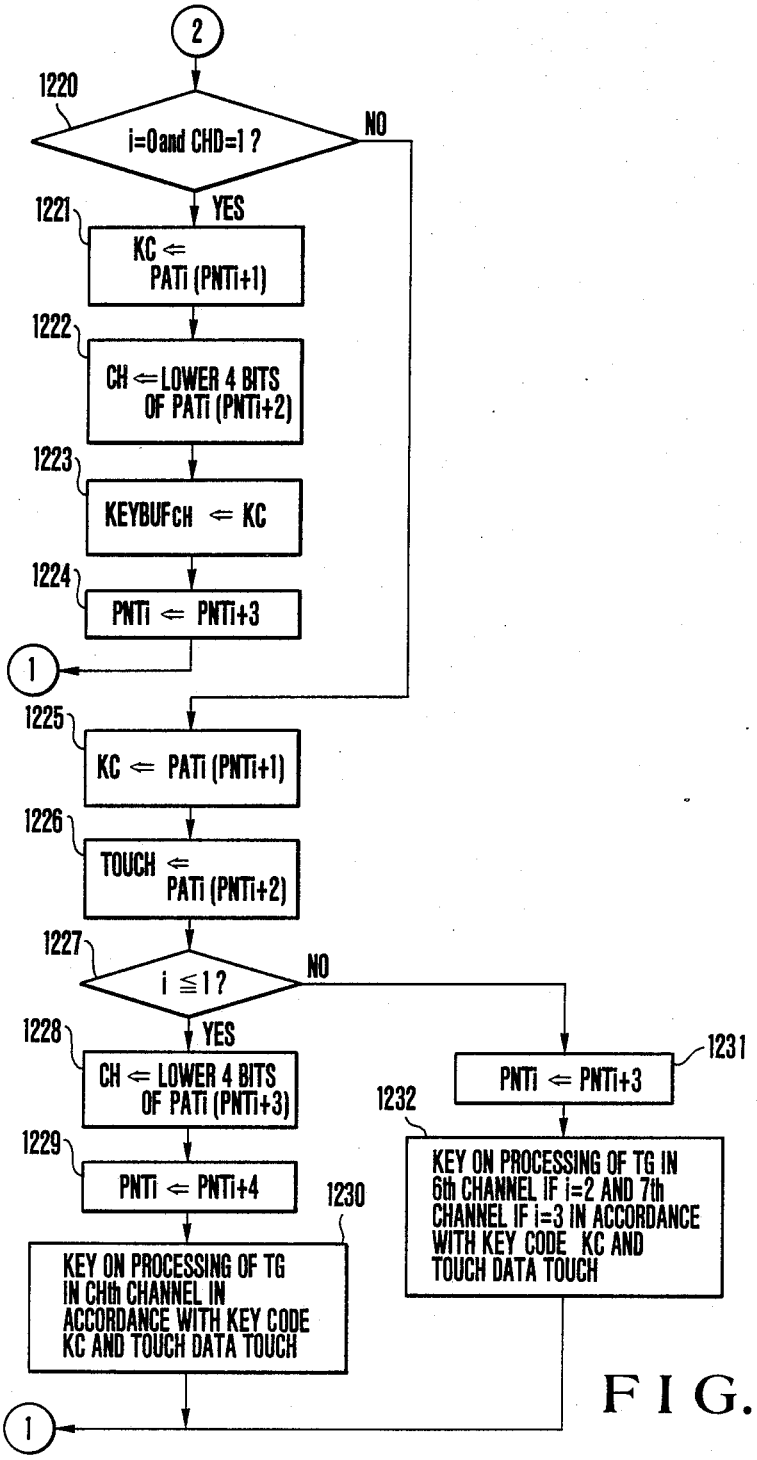

Referring to FIGS. 15A and 15B, in step 1201, 1 is stored in the register i as an initial value. Then, in step 1202, the CPU 10 checks whether the ith bit of the register MODP is 1, i.e., whether the sequencer i is in the play mode. If Y in step 1202, the flow advances to step 1203. If N in step 1202, the sequencer i need not be subjected to the read processing. Therefore, the flow advances to step 1206, and i is incremented by one. In step 1207, the CPU 10 checks whether processing for all the sequencers is finished. If Y in step 1207, the flow returns. If N in step 1207, the flow returns to step 1202, and similar processing for the next sequencer is performed.

In step 1203, the CPU 10 checks whether the MSB of a position represented by the pointer $PNT_i$ of the sequencer memory $PAT_i$ of the above sequencer is 1. If Y in step 1203, the position represents measure unit data or another code. Therefore, the flow advances to step 1204, and the CPU 10 checks whether the position represents the measure unit data BEH. If Y in step 1204, the flow advances to step 1202, and the processing is continuously performed. If N in step 1204, i.e., the position represents data other than the measure unit data, processing corresponding to the data is performed in step 1205. Then, the flow advances to step 1206, and the processing is continuously performed.

In step 1208, the CPU 10 compares timing data stored in the position represented by the pointer $PNT_i$ of the sequencer memory $PAT_i$ with the tempo clock CLK. If the timing data does not coincide with the tempo clock CLK, the flow advances to step 1206, and processing for the next sequencer is performed. If the timing data stored in the sequencer memory coincides with the tempo clock CLK in step 1208, the flow advances to step 1209 to perform the tone generation processing.

In step 1209, the CPU 10 checks whether a position of the pointer $PNT_i+1$ of the sequencer memory $PAT_i$ is 8XH. Note that X is 0 to FH. If upper four bits of the $PAT_i$ ($PNT_i+1$) are 8H, the data is key off event data. Therefore, in step 1210, lower four bits (in which the assigned tone generation channel is written) are stored in the register CH. In step 1211, the key off processing is performed for the tone generation channel CH of the tone generator 26. In step 1212, the pointer $PNT_i$ is updated, and the flow returns to step 1203.

If the upper four bits are not 8H in step 1209, the flow advances to step 1213. In step 1213, the CPU 10 checks whether the register i is 3 and the register BS is 1, i.e., whether a currently-processed sequencer is the sequencer 3 and the auto base mode is set. If Y in step 1213, data (the second byte of the format of the bass tone generation in FIG. 2B) at a position of the pointer $PNT_i+1$ of the sequencer memory $PAT_i$ is stored in the register CHORD in step 1214. Then, the pointer $PNT_i$ is updated, and the flow advances to step 1203.

If N in step 1213, the CPU 10 checks in step 1216 whether the data at the position of the pointer $PNT_i+1$ of the sequencer memory $PAT_i$ is the BFH representing the end. If Y in step 1216, 0 is set in the ith bit of the register MODP in step 1217 to release the play mode of the sequencer i. In step 1218, the CPU 10 checks whether the other sequencers are in the play mode. If none of the sequencers is in the play mode, 0 is stored in the register RUN to stop the register RUN in step 1219, and the flow returns. If any of the sequencers is in the play mode, the flow advances to step 1206 to continuously perform the processing.

If N in step 1216, the CPU 10 checks in step 1220 whether the register i is 0 and the register CHD is 1, i.e., whether the currently-processed sequencer is the sequencer 0 and the auto chord mode is set. If Y in step 1220, a key code is read out from a position of the pointer $PNT_i+1$ of the sequencer memory $PAT_i$ and stored in the read register KC in step 1221. In step 1222, data of an assigned tone generation channel stored in lower four bits of a position of the pointer $PNT_i+2$ of the sequencer memory $PAT_i$ is stored in the register CH. In step 1223, the key code KC is stored in the key code buffer $KEYBUF_{CH}$, the pointer $PNT_i$ is updated, and then the flow returns to step 1203.

If N in step 1220, a key code stored in a position of the pointer $PNT_i+1$ of the sequencer memory $PAT_i$ is stored in the register KC in step 1225. In step 1226, the touch data stored in a position next to the above position is stored in the register TOUCH. In step 1227, the CPU 10 checks whether the register i is 1 or less, i.e., whether the number of the currently-processed sequencer is 0 or 1. If Y in step 1227, an assigned tone generation channel stored in lower four bits of the pointer $PNT_i+3$ of the sequencer memory $PAT_i$ is stored in the register CH in step 1228. In step 1229, the pointer $PNT_i$ is updated. In step 1230, the key on processing of the tone generator 26 in a tone generation channel of the CHth channel is performed in accordance with the key code KC and the touch data TOUCH. Thereafter, the flow returns to step 1203.

If the currently-processed sequencers are the sequencers 2 and 3 in step 1227, the pointer $PNT_i$ is updated in step 1231. In step 1232, the key on processing of the tone generator is performed in accordance with the key code KC and the touch data TOUCH in the 6th channel if the register i is 2 or the 7th channel if it is 3. Thereafter, the flow returns to step 1203.

13. Bass Accompaniment Tone Generation Processing

A bass accompaniment tone generation processing subroutine BASS is called when the auto bass mode is set in the above interrupt processing performed by the tempo clock.

Figure 16:
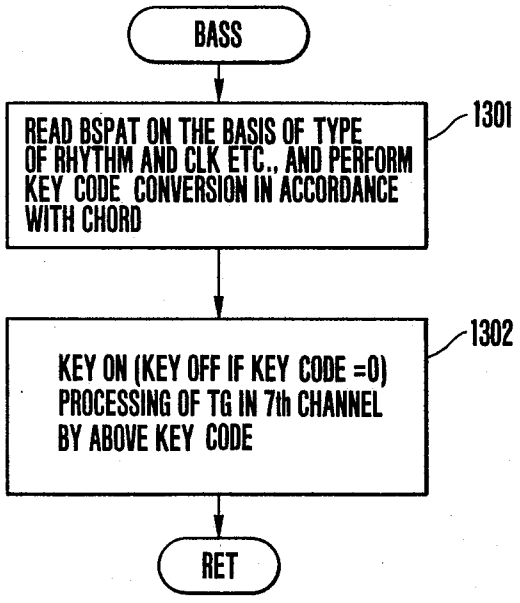
FIG. 16 is a flow chart for explaining a bass accompaniment tone generation processing routine of the electronic musical instrument in FIG. 1.

Referring to FIG. 16, in step 1301, data is read out from the pattern memory BSPAT on the basis of, e.g., the type of rhythm and the tempo clock CLK which are set in advance, and key code conversion is performed in accordance with the value of the register CHORD. The register CHORD already stores chord information for bass accompaniment read out from the sequencer memory in step 1214 in the above sequencer read processing READ. Then, in step 1302, the key on processing of the tone generator 26 is performed in the tone generation channel 7 by the above key code. Note that when the key code is 0, key off is performed. Thereafter, the flow returns.

14. Chord Accompaniment Tone Generation Processing

A chord accompaniment tone generation processing subroutine CHORD is called when the auto chord mode is set in the interrupt processing performed by the tempo clock.

Figure 17:
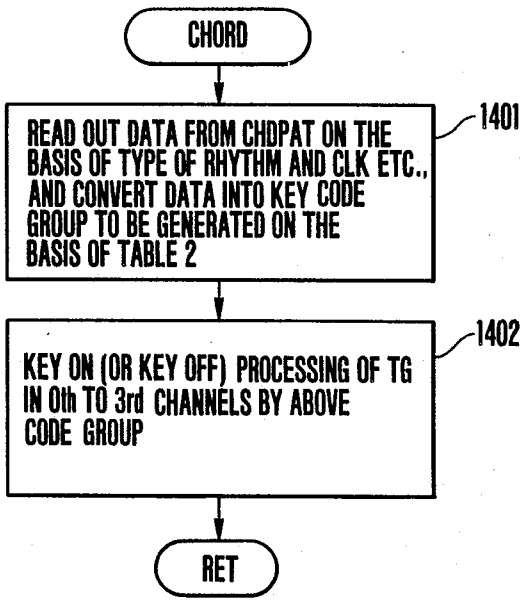
FIG. 17 is a flow chart for explaining a chord accompaniment tone generation processing routine of the electronic musical instrument in FIG. 1.

Referring to FIG. 17, in step 1401, data is read out from the pattern memory CHDPAT on the basis of, e.g., the type of rhythm and the tempo clock which are set in advance and converted into key codes to be generated on the basis of Table 2 described above. Then, in step 1402, the key on processing (or the key off processing) of the tone generator 26 is performed in the tone generation channels of the 0th to 3rd channels by the above key codes, and the flow returns.

15. Measure End Write Processing

A measure end write processing subroutine BARREC is called when the tempo clock becomes a value representing the measure end and a sequencer in the REC mode is present in the interrupt processing performed by the tempo clock described above.

Figure 18:
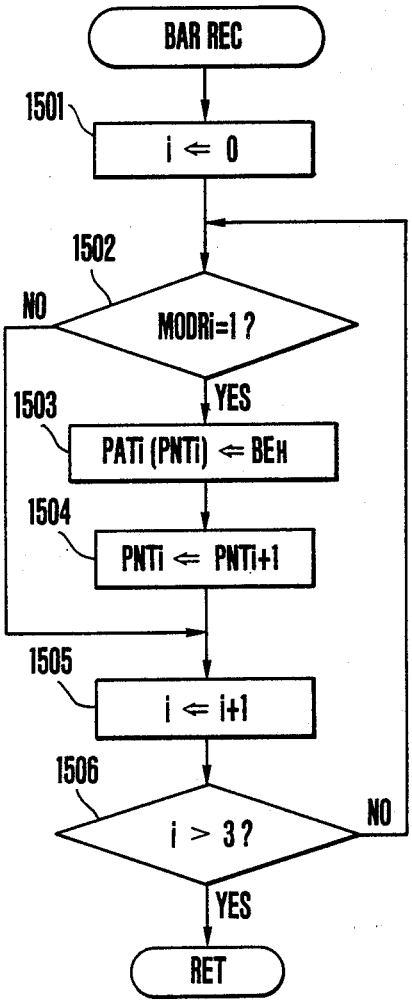
FIG. 18 is a flow chart for explaining a measure end write processing of the electronic musical instrument in FIG. 1.

Referring to FIG. 18, in step 1501, 0 is stored in the register i as an initial value. Then, in step 1502, the CPU 10 checks in accordance with the register MODR whether the sequencer i is in the REC mode. If Y in step 1502, data BEH representing the measure end is stored in a position of the pointer $PNT_i$ of the sequencer memory $PAT_i$ in step 1503. In step 1504, the pointer $PNT_i$ is updated, and the flow advances to step 1505. If N in step 1502, the flow directly advances to step 1505 to continuously perform the processing. In step 1505, the register i is incremented by one. In step 1506, the CPU 10 checks whether the register i is three or more, i.e., whether processing for all the four sequencers is finished. If Y in step 1506, the flow returns. If N in step 1506, the flow returns to step 1502 to continuously perform the processing.

16. Measure End Skip Processing

A measure end skip processing subroutine BARSKIP is called when the tempo clock becomes a value representing the measure end and a sequencer in the play mode is present in the interruption processing performed by the tempo clock described above.

Figure 19:
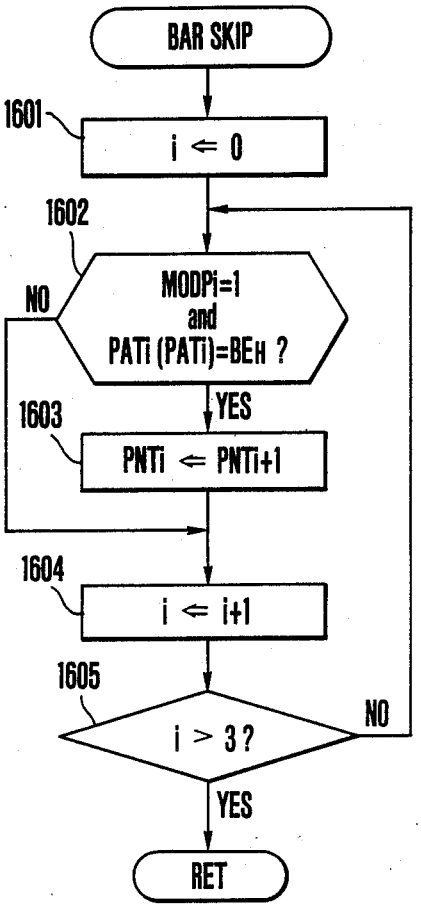
FIG. 19 is a flow chart for explaining a measure end skip processing routine of the electronic musical instrument in FIG. 1.

Referring to FIG. 19, in step 1601, 0 is stored in the register i as an initial value. Then, in step 1602, the CPU 10 checks whether the ith bit of the register MODP is 1 and a position of the pointer $PNT_i$ of the sequencer memory $PAT_i$ is BEH, i.e., whether the sequencer i is set in the play mode and the pointer $PNT_i$ is located at a position of the measure end data in the sequencer memory. If Y in step 1602, the pointer is incremented to designate a start position of the next measure in step 1603, and the flow advances to step 1604. If N in step 1602, the flow advances to step 1604 to continuously perform the processing. In step 1604, the register i is incremented by one. In step 1605, the CPU 10 checks whether the register i is three or more, i.e., whether processing for all the four sequencers is finished. If Y in step 1605, the flow returns. If N in step 1605, the flow returns to step 1602 to continuously perform the processing.

Note that the present invention is not limited to the above embodiment but can be arbitrarily modified and practiced.

For example:

1. A tone generation channel belonging to a sequencer number in the play mode is not assigned in the above embodiment. However, the channel may be assigned.

2. In the above embodiment, writing is performed with accuracy of clock resolution (96/measure). However, in consideration of variation correction, writing data may be quantized more roughly.

3. Tone generation channels are assigned to from the key depressed first and key depression beyond the number of tones which can be generated is excluded. However, assignment may be performed by another method, e.g., from the last one.

4. In the above description, only the key depression information is written. However, rhythm information, switch information, and the like may be written.

What is claimed is:

1. An electronic musical instrument, comprising:

means for designating performance data for plural performance parts of a musical piece;

tone generation channel means for generating tones in accordance with designated performance data, including plural tone generation channels, each of which generates a tone of music;

tone generation number designating means for designating maximum simultaneous tone generation numbers a maximum simultaneous tone generation number being independently designated for each of said plural performance parts; and tone generation channel assigning means for assigning each of said plural performance parts to at least one available tone generation channel, the number of available tone generation channels for a particular performance part being equal to the maximum simultaneous tone generation number designated for the particular performance part.

2. A musical instrument according to claim 1, wherein a total sum of said designated maximum simultaneous tone generation numbers falls within a range of a total number of said tone generation channels of said electronic musical instrument.

3. A musical instrument according to claim 2, wherein said plural performance parts consist of an automatic performance part and a melody part, said tone generation channels being independently assigned to the automatic performance part and the melody part.

4. An electronic musical instrument according to claim 1, wherein a maximum simultaneous tone generating number equal to one is designated for one of said plural performance parts.

5. An electronic musical instrument according to claim 1, wherein the tone generation number designating means comprises:

plurals sub-parts each of which corresponds to a predetermined number of tone generation channels;

means for selecting at least one of said sub-parts for a performance part;

wherein said maximum simultaneous tone generating number for a performance part is equal to a number determined from the total sum of said tone generation channels of all sub-parts in a group of sub-parts selected by said sub-part selecting means.

6. An electronic musical instrument as set forth in claim 1, wherein said tone generation number designating means comprises:

plural sequence areas each of which corresponds to a predetermined number of tone generation channels;

means for selecting at least one of said sequence areas for a performance part;

wherein said maximum simultaneous tone generation number for a performance part is equal to a number determined from the total sum of said tone generation channels of all sequence areas in a group of sub-parts selected by said sequence areas selecting means.

7. An electronic musical instrument, comprising:

performance part designating means for designating performance data for plural performance parts of a musical piece;

means for selecting one of a recording mode and a reproducing mode in which when a recording mode is selected, designated performance data is recorded and when a reproducing mode is selected, previously recorded performance data is reproduced;

means for generating tones in accordance with designated performance data, including plural tone generation channels; and memory means for, in the recording mode, assigning performance data for each one of the plural performance parts to a number of tone generation channels independently designated by a performer and storing the data, wherein said tone generation channels are assigned to each performance part in the recording mode within a range of the total sum of tone generation channels corresponding to each performance part.

8. A musical instrument according to claim 7, further comprising mode switching means for switching the recording mode to the reproducing mode when a stop is designated in the recording mode.

9. An electronic musical instrument, comprising:
means for designating performance data;
selecting means for selecting one of a recording mode for recording performance data, a reproducing mode for reproducing recorded performance data, release of the recording mode, and release of the reproducing mode;
memory means for, in the recording mode, storing performance data;
musical tone generating means for, in the reproducing mode, reading out performance data from said memory means and generating a corresponding musical tone;
designating means for designating one of storage of performance data in the recording mode, execution, and a stop of musical tone generation processing in the reproducing mode; and
control means for receiving a stop signal and stopping the recording mode and automatically switching the recording mode to the reproducing mode in response to the stop signal in the recording mode.

10. A musical instrument according to claim 9, wherein said memory means is provided for each of plural performance parts, and said selecting means for selecting the recording mode, the reproducing mode, release of the recording mode, and release of the reproducing mode is provided independently for each of the plural performance parts.

11. An electronic musical instrument, comprising:
means for designating performance data for a performance part of a musical piece;
means for selecting one of a recording mode and a reproducing mode, in which when a recording mode is selected, designated performance data is recorded and when a reproducing mode is selected, recorded performance data is reproduced;
means for generating tones, including plural tone generation channels;
tone generation number designating means for designating maximum simultaneous tone generation numbers, a maximum simultaneous tone generation number to be designated independently for each of the plural performance parts in a recording mode;
means for, int he recording mode, assigning each of the plural performance parts to at least one available tone generation channel, the number of available tone generation channels for a particular performance part being equal to the maximum simultaneous tone generation number designated for the particular performance part; and
memory means for, in the recording mode, assigning performance data to available tone generation channels and storing the data.

12. An electronic musical instrument, comprising:
means for designating performance data for plural performance parts of a musical piece;
means for generating tones in accordance with designated performance data, including plural tone generation channels;
means for independently designating at least one tone generating channel for each performance part;
means for assigning each performance part to at least one available tone generation channel, the number of available tone generation channels for a particular performance part being equal to the number of tone generation channels designated for the particular performance part.

13. An electronic musical instrument, comprising:
means for designating performance data for plural performance parts of a musical piece;
means for generating tones in accordance with designated performance data, including plural tone generation channels;
plural means for recording performance data in a recording mode; and
plural means for reproducing recorded performance data in a reproducing mode, each reproducing means corresponding to a respective recording means and each recording means and corresponding reproducing means being designated for at least one predetermined tone generation channel;
wherein at least one tone generation channel is independently designated for each performance part in a recording mode; and
wherein each performance part is assigned to at least one available tone generation channel, the number of available tone generation channels for a particular performance part being equal to the number of tone generation channels designated for the particular performance part.

* * * * *